US009518453B2

(12) United States Patent
Dilber et al.

(10) Patent No.: US 9,518,453 B2
(45) Date of Patent: Dec. 13, 2016

(54) EXPANDABLE LINER HANGER WITH ANCHORING FEATURE

(71) Applicant: Baker Hughes Incorporated, Houston, TX (US)

(72) Inventors: Halit L. Dilber, Katy, TX (US); Chee K. Yee, Katy, TX (US); Robert O. Castillo, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 531 days.

(21) Appl. No.: 14/020,138

(22) Filed: Sep. 6, 2013

(65) Prior Publication Data

US 2015/0068733 A1 Mar. 12, 2015

(51) Int. Cl.
*E21B 43/10* (2006.01)
*E21B 23/01* (2006.01)

(52) U.S. Cl.
CPC ..... *E21B 43/103* (2013.01); *E21B 23/01* (2013.01)

(58) Field of Classification Search
None
See application file for complete search history.

(56) References Cited

U.S. PATENT DOCUMENTS 6,098,717 A 8/2000 Bailey et al.
6,513,600 B2 2/2003 Ross
6,688,399 B2 2/2004 Maguire et al.
6,691,789 B2 2/2004 Jackson et al.
7,306,034 B2 12/2007 Garcia
8,371,388 B2 2/2013 Moeller et al.
8,443,881 B2 5/2013 Thomson et al.
2003/0047323 A1* 3/2003 Jackson ..... E21B 43/103 166/380
2006/0063627 A1* 3/2006 Tomobuchi ..... F16G 1/28 474/205
2007/0039161 A1* 2/2007 Garcia ..... E21B 43/103 29/507
2008/0210440 A1 9/2008 Stuart et al.
2009/0205843 A1* 8/2009 Gandikota ..... E21B 33/1208 166/387
2009/0242214 A1* 10/2009 Foster ..... E21B 23/01 166/387
2011/0247832 A1 10/2011 Harris

* cited by examiner

*Primary Examiner* — Jennifer H Gay
*Assistant Examiner* — Caroline Butcher
(74) *Attorney, Agent, or Firm* — Steve Rosenblatt

(57) ABSTRACT

An expandable liner hanger features carbide or other hard particles adhered to the outer surface of a tubular mandrel that is expanded using vulcanized rubber to retain the carbide during run in or set. The rubber can be directly applied to the outer surface of the mandrel or to a split ring that is subsequently secured to the outer surface of the mandrel. The rubber can also be mounted in an exterior recess to protect the carbide during running in from being knocked off with impact. A binder can be applied to the carbide or to the rubber for better fixation of the carbide when vulcanizing the rubber. The rubber moves with the expanding mandrel while binding the carbide until contact of the carbide to the surrounding tubular transfers the liner string weight to the surrounding tubular through the carbide.

16 Claims, 2 Drawing Sheets

EXPANDABLE LINER HANGER WITH ANCHORING FEATURE

FIELD OF THE INVENTION

The field of the invention is liner hangers and more specifically liner hangers set by mandrel expansion and that feature an external hard material adhered in a manner to remain in position as expansion takes place.

BACKGROUND OF THE INVENTION

Different designs have been offered for expandable liner hangers. In one design a pattern of grooves with a sealing material are placed on the outer surface of the hanger. Surrounded by the groove are carbide segments that are fabricated into the tubular body or are buttons with teeth or using raised or serrated members on the outer surface of the tubular or hardened tooth patterns on the outer surface. Such designs are illustrated in U.S. Pat. No. 6,688,399 and U.S. Pat. No. 6,691,789. A similar design illustrating hardened inserts retained in pockets on the outer surface of a tubular are shown in U.S. Pat. No. 8,443,881. U.S. Pat. No. 6,098,717 illustrates an expandable liner hanger with a seal in some embodiments.

These designs are expensive to fabricate the complex pattern of grooves and the application of the seal material that fits in the grooves. The manner of applying the carbide was also prone to dislodge the particles.

Another design uses a series of rubber sleeves to seal and support the liner weight as indicated in U.S. Pat. No. 8,371,388. The use of rubber for both these functions requires many rings and long tool length with a resulting difficulty in running in in certain applications with limited weight capacity.

What is needed and provided by the present invention is a way to apply the hardened material or carbide so that it will stay put for run as well as during expansion. The mounting method involves taking uncured rubber into a slurry form with a fluid such as methyl ethyl ketone (MEK) and applying the slurry to the liner hanger body directly or to a support that is subsequently fitted on the hanger body. A bonding agent or adhesive is applied to the hardened particles or carbide and allowed to dry before adding such particles to the rubber slurry. The combination of the rubber slurry and carbide particles is autoclaved in an oven to vulcanize the rubber. In use the rubber retains the carbide during expansion and allows the load to be transferred from the supported string through the carbide to the expanded mandrel. The assembly of carbide retained with the vulcanized rubber can be placed directly in a recess for protection against abrasion during running in. Alternatively, the assembly can be mounted to a support ring that can be disposed in a recess on the mandrel outer wall. Those skilled in the art will better appreciate additional aspects of the invention from a review of the description of the preferred embodiment and the associated drawings while recognizing that the full scope of the invention is to be determined from the appended claims.

SUMMARY OF THE INVENTION

An expandable liner hanger features carbide or other hard particles adhered to the outer surface of a tubular mandrel that is expanded using vulcanized rubber to retain the carbide during run in or set. The rubber can be directly applied to the outer surface of the mandrel or to a split ring that is subsequently secured to the outer surface of the mandrel. The rubber can also be mounted in an exterior recess to protect the carbide during running in from being knocked off with impact. A binder can be applied to the carbide or to the rubber for better fixation of the carbide when vulcanizing the rubber. The rubber moves with the expanding mandrel while binding the carbide until contact of the carbide to the surrounding tubular transfers the liner string weight to the surrounding tubular through the carbide.

DETAILED DESCRIPTION OF THE PREFERRED EMBODIMENT

Figure 1:
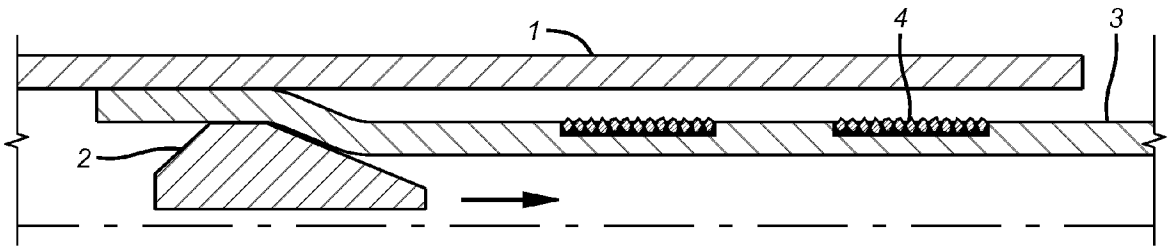
FIG. 1 shows the liner hanger in position at the initiation of expansion.
Figure 2:
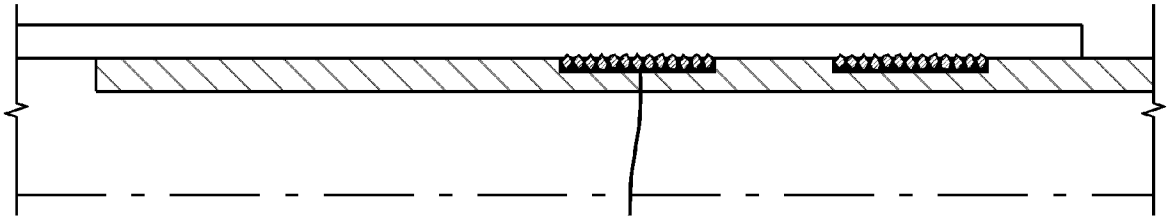
FIG. 2 is the view of FIG. 1 after expansion is completed.
Figure 3:
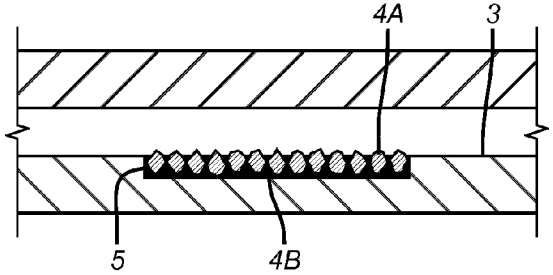
FIG. 3 is a close up view of FIG. 1.
Figure 4:
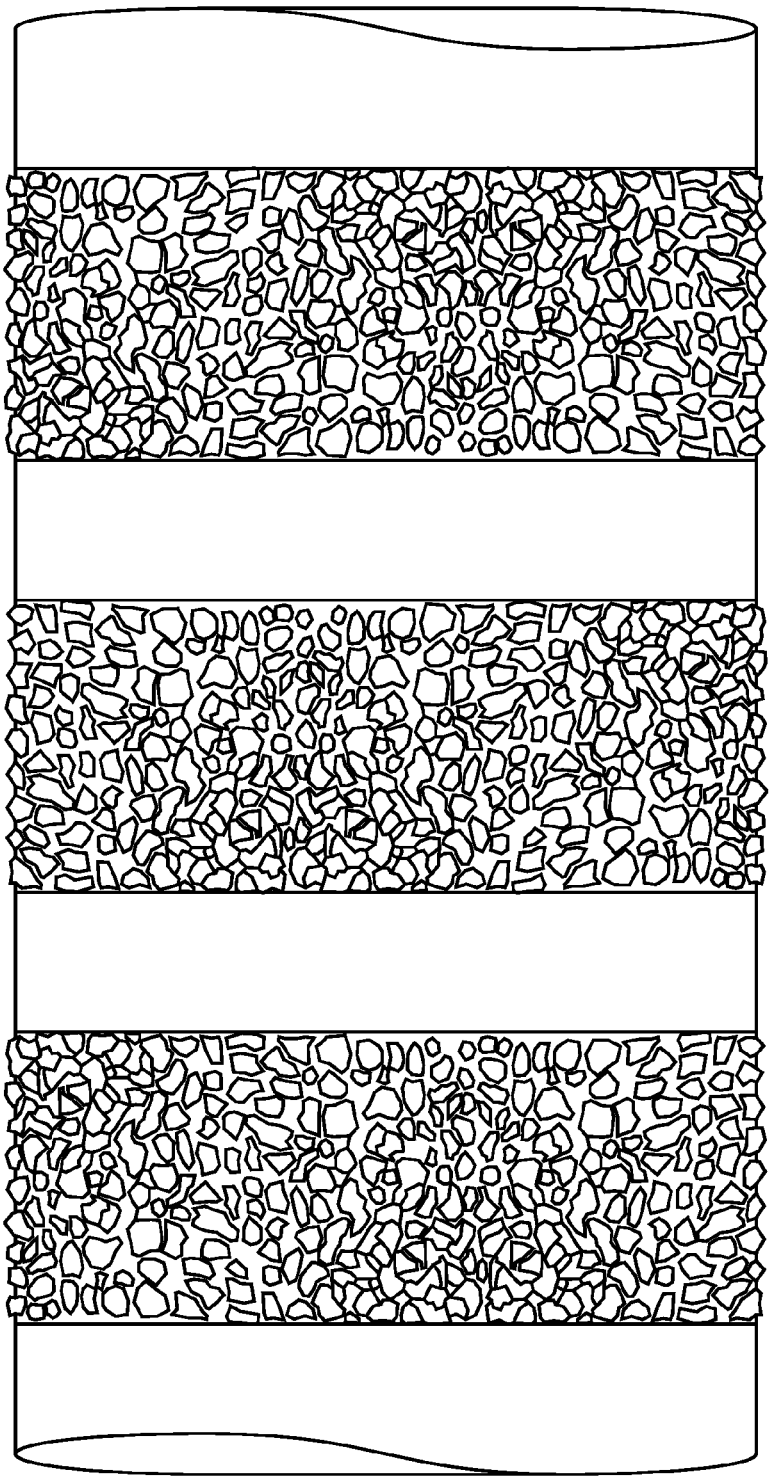
FIG. 4 shows three bands of carbide imbedded in vulcanized rubber mounted on the exterior of a mandrel.

Referring to FIG. 1 the liner hanger 3 is positioned within a surrounding tubular 1 and then expanded with swage 2. This expansion brings the sealing rings 4 against the surrounding tubular 1 as shown in FIG. 2. FIG. 3 illustrates the hardened particles or carbide 4*a* retained by vulcanized rubber 4*b* that is mounted in a recess 5. The rubber 4*b* can be vulcanized in the recess 5 or mounted on a split ring 6 that can then be snapped over the mandrel of the liner hanger 3. FIG. 4 illustrates three bands of carbide bound by the vulcanized rubber. As can be seen much of the carbide 4*a* is visible on the exterior of the rubber while within the rubber the carbide 4*a* is also supported on mandrel 3 of the liner hanger or on an intermediate support such as split ring 6.

The assembly method involves bonding the carbide chips using a rubber binder. Rubber in an uncured state is mixed with an agent such as (MEK) or equivalent into liquid slurry. The rubber cement is then brushed on the hanger 3 outside diameter. The carbide chips 4*a*, are soaked with bonding agent and dried and applied directly onto the rubber cement. The carbide chips with rubber cement are then vulcanized to the hanger outside diameter and placed inside an oven where the temperature is elevated.

Upon expansion of the hanger body during deployment of the liner hanger, the rubber is radially stretched as the hanger body is being swaged. The carbide chips remain bonded to the rubber and further trapped between the hanger body and the surrounding casing. The carbide chips penetrate into the surrounding casing as well as the hanger outside diameter. A groove 5 is machined in the mandrel outside diameter to trap the carbide chips for ease of manufacturing as well as preventing washout during running in hole. The carbide chips can enhance the hanging capacity over 2.3 times compared to a metal-to-metal press fit design.

Those skilled in the art will appreciate that other agents or materials can serve to make the slurry with the rubber that will act as the binder for the carbide. The bonding agent can be applied to the carbide or the rubber or both. Other hard particles or ceramics or diamonds can be used instead of tungsten carbide.

The use of an elastic material for a binder for the carbide or equivalent allows continuing fixation as the mandrel is expanded with retention of the particles until contact with the opposing tubular is contacted and the load of the hanging weight is transferred. The presence of the binder also assists in fixation of the carbide as it penetrates the opposing tubular and the liner hanger mandrel during the setting process involving expansion. While a fixed dimension swage is illustrated variable swages or other expansion techniques can be employed such as pressure applied between spaced isolation devices or mechanical axial compression of the liner hanger in the vicinity of the bands of carbide. While three parallel bands are illustrated, differing number of band can be used. The width of the bands can be the same or different or the bands can be a series of spirals that are circumferentially spaced or a single spiral that wraps at least 360 degrees.

The above description is illustrative of the preferred embodiment and many modifications may be made by those skilled in the art without departing from the invention whose scope is to be determined from the literal and equivalent scope of the claims below:

We claim:

1. An expandable liner hanger, comprising:

a tubular mandrel having an outer surface;

a plurality of hard particles fixated at least in part within a layer of a flexible material on said outer surface;

said layer of flexible material disposed in a recess of the outer surface having an inner surface against said mandrel and an outer surface opposite said inner surface, said hard particles extending through said outer surface of the flexible material and embedded in said layer short of said inner surface.

2. The hanger of claim 1, wherein: said flexible material is affixed directly to said outer surface of the tubular mandrel.

3. The hanger of claim 1, wherein: said flexible material is affixed to an intermediate support member mounted to said outer surface of the tubular mandrel.

4. The hanger of claim 3, wherein:

said intermediate support member comprises a split ring.

5. The hanger of claim 1, wherein: said flexible material extends in at least one band that extends for at least 360 degrees around said outer surface of the tubular mandrel.

6. The hanger of claim 5, wherein:

said at least one band comprises multiple bands having the same or different widths.

7. The hanger of claim 5, wherein:

said at least one band comprises a spiral.

8. The hanger of claim 1, wherein:

said flexible material comprises rubber.

9. The hanger of claim 8, wherein:

said hard particles comprise carbide.

10. The hanger of claim 9, wherein:

said rubber is vulcanized with said carbide mounted at least in part in said rubber.

11. The hanger of claim 10, wherein:

an adhesive is placed on at least one of said rubber and said carbide.

12. The hanger of claim 8, wherein:

said rubber is slurried with methyl ethyl ketone when mounted to said mandrel before adding said hard particles to said slurry.

13. An expandable liner hanger, comprising:

a tubular mandrel having an outer surface;

a plurality of hard particles fixated at least in part within a layer of a flexible material on said outer surface;

said layer of flexible material having an inner surface against said mandrel and an outer surface opposite said inner surface, said hard particles extending through said outer surface of the flexible material and embedded in said layer short of said inner surface;

said outer surface of the tubular mandrel comprises a recess;

said flexible material is disposed in said recess;

said hard particles are also disposed in the same said recess and extend through said flexible material within said recess without initial contact of a bottom surface of said recess and outwardly beyond said recess.

14. The hanger of claim 13, wherein:

said flexible material is affixed directly to said tubular mandrel within said recess.

15. The hanger of claim 13, wherein:

said flexible material is indirectly fixed to said tubular mandrel in said recess.

16. The hanger of claim 15, wherein:

said indirect fixation comprises a split ring.

* * * * *